US006488169B1

(12) United States Patent
Magnusson et al.

(10) Patent No.: US 6,488,169 B1
(45) Date of Patent: Dec. 3, 2002

(54) COMBINATION FLASK FOR PILLS AND LIQUID THEREFOR

(76) Inventors: Harold A. Magnusson, 365 Jeff Miller Rd., Tolland, MA (US) 01034; Nancy C. Magnusson, 365 Jeff Miller Rd., Tolland, MA (US) 01034

( * ) Notice: Subject to any disclaimer, the term of this patent is extended or adjusted under 35 U.S.C. 154(b) by 42 days.

(21) Appl. No.: 09/825,529

(22) Filed: Apr. 3, 2001

(51) Int. Cl.[7] ..... B65D 1/04

(52) U.S. Cl. ..... 220/23.87; 215/379; 220/522; 220/DIG. 13; D11/96

(58) Field of Search ..... 220/23.87, DIG. 13, 220/522, 256.1, 259.3; 215/228, 397, 399, 379; 206/37, 538, 540, 457; 63/1.14; D11/96; D7/615; D99/27

(56) References Cited

U.S. PATENT DOCUMENTS

| | | | | | |
|---|---|---|---|---|---|
| D77,081 | S | * | 12/1928 | Edmiston et al. | D9/307 |
| D95,983 | S | * | 6/1935 | Puciloski | D99/27 |
| 2,194,379 | A | * | 3/1940 | Bicks | 215/399 |
| D156,025 | S | * | 11/1949 | Mulholland | D26/10 |
| 2,940,107 | A | * | 6/1960 | Sterling | 215/228 |
| 2,941,689 | A | * | 6/1960 | Black | 206/232 |
| 3,086,671 | A | * | 4/1963 | Zaleski | 215/398 |
| 3,153,490 | A | * | 10/1964 | Bramming | 215/329 |
| 3,446,179 | A | * | 5/1969 | Bender | 116/308 |
| D215,200 | S | * | 9/1969 | Dobyns | D9/307 |
| 3,840,136 | A | * | 10/1974 | Lanfranconi et al. | 206/222 |
| 4,183,328 | A | * | 1/1980 | Lawrence | 119/603 |
| 4,924,773 | A | * | 5/1990 | Gwilliam | 101/327 |

* cited by examiner

*Primary Examiner*—Lee Young
*Assistant Examiner*—Joseph C. Merek
(74) *Attorney, Agent, or Firm*—Alix, Yale & Ristas, LLP

(57) ABSTRACT

A combination flask for carrying a quantity of liquid and a quantity of pills which includes a housing that includes a fluid impervious first chamber. The first chamber has an opening. The housing is generally cross-shaped and the cross-shaped housing includes four generally elliptical sections of which first and second generally elliptical sections are generally coaxial and second and third elliptical sections are also generally coaxial. In a preferred form of the invention, the pill container is received within a neck of the housing, and the chamber includes substantially all of said second, third and fourth elliptical sections. A cap dimensioned and configured for engaging the housing encloses the pill container and the housing opening and selectively prevents liquid passing into said pill container.

14 Claims, 6 Drawing Sheets

COMBINATION FLASK FOR PILLS AND LIQUID THEREFOR

BACKGROUND OF THE INVENTION

This invention relates to medical apparatus and particularly to apparatus for carrying pills as well as containers for a volume of liquid sufficient to enable a user to consume a pill.

In some cases it is of great urgency that a specific pill be taken. For example, some heart patients may experience chest pains and should take pills, such as aspirin, very promptly as recommended by their physician. In some cases, any delay may be fatal. In other cases, people have a complex schedule of multiple pill dosages throughout each day. A problem encountered by such users is to not only have the pills available when they are required, but also to not have a sufficient quantity of liquid readily available to allow them to consume the pills. A sufficient quantity of liquid is particularly imperative with some large pills and particularly imperative for some individuals who can not easily swallow or chew pills even under emergency conditions.

There are known collapsible cups and separate pill storage containers of various types known in the prior art. Such apparatus have not been wholly satisfactory.

SUMMARY OF THE INVENTION

An object of the invention is to provide apparatus, which in a single flask, will hold both a supply of pills and a supply of a liquid suitable for consuming the pills.

Another object of the invention is to provide such a flask that is easy to grasp—particularly by persons that may be handicapped such as those having arthritis or other limitations on their ability to manipulate such a container.

Still another object of the invention is to provide a flask that enables a person, including even a handicapped person, to readily open and close the flask.

Still another object of the invention is to provide a construction which enables the user to easily grasp the flask and that is shaped to accommodate two of the user's fingers.

It is now been found that these and other objects of the invention may be attained in a combination receptacle apparatus for carrying a quantity of liquid and a quantity of pills which includes a housing having a neck that receives a removable pill chamber. The pill chamber has an opening and is configured upon insertions into the housing to be fluid impervious. The housing further defines a primary chamber that is accessible when the pill chamber is removed. The flask selectively prevents liquid passage out of said second chamber and selectively prevents liquid passage into the first chamber. The housing is generally cross-shaped and the cross-shaped housing includes four generally elliptical sections of which first and second generally elliptical sections are generally coaxial and second and third elliptical sections are also generally coaxial.

The pill chamber is receivable within said first elliptical section. The primary chamber includes substantially all of said second, third and fourth elliptical sections. The structure for selectively preventing liquid passing into said pill chamber may include a cap dimensioned and configured for engaging the opening in the pill chamber. The structure for selectively preventing liquid passing out of the primary chamber may include the received pill chamber and its sealing interface with the housing and the cap.

The axial extremities of the caps may have parts thereof that are shaped whereby the housing is capable of standing upright on a flat horizontal surface.

The third and fourth elliptical sections may have axial extremities that include a dish-shaped end recess and each of the recesses is dimensioned and configured to accommodate a finger of a user. The housing exterior may be configured for engagement with an associated key ring and/or a lace that allows the flask to be worn around the user's neck or mounted to other objects.

BRIEF DESCRIPTION OF THE DRAWING

The invention will be better understood by reference to the accompanying drawing in which.

DESCRIPTION OF THE PREFERRED EMBODIMENT

Figure 1:
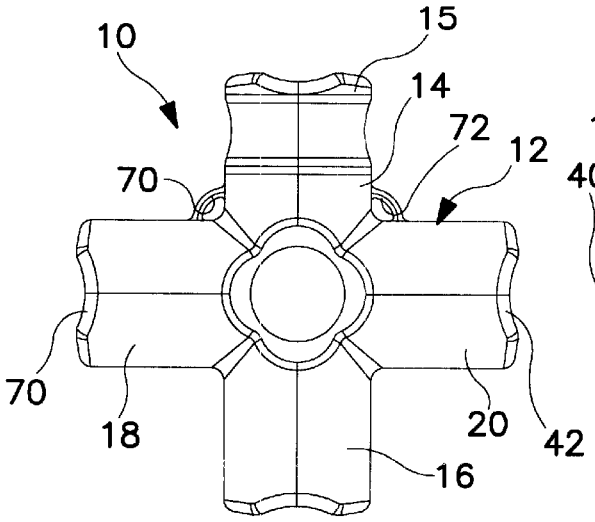
FIG. 1 is a front elevational view of one embodiment of a flask in accordance with the present invention.
Figure 3:
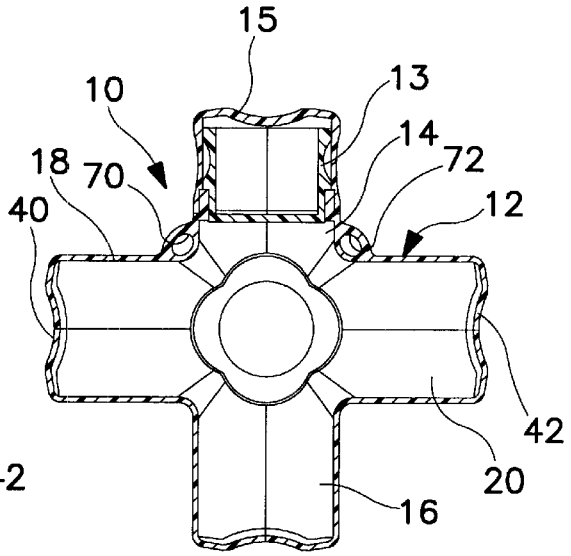
FIG. 3 is a sectional view of the flask of FIG. 2 taken along the line A—A thereof.
Figure 2:
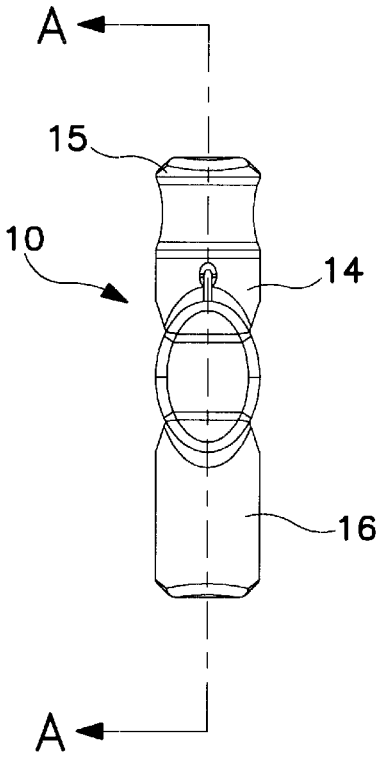
FIG. 2 is a side elevational view of the flask of FIG. 1.
Figure 4:
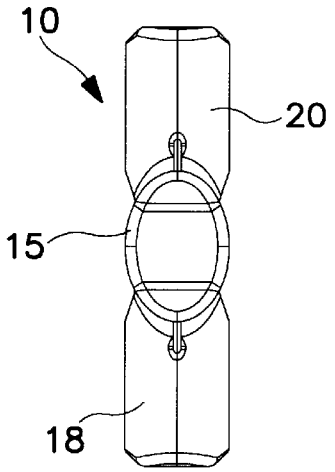
FIG. 4 is a top plan view, reoriented at a 90° angle, of the flask of FIG. 1.

Referring now to the drawings, a flask which functions as a container for holding a supply of pills and a quantity of liquid for consuming the pills is generally designed by the numeral 10. The flask 10 comprises a housing 12 which receives a removable pill container 13 and a cap 15.

The housing 12 will be seen to be generally cross-shaped and to include four sections each having a generally elliptical shaped cross-section. For the purposes of description the housing may be described as having a first elliptical section 14 forming a neck 17, and a second elliptical section 16. The elliptical sections 14 and 16 are disposed in coaxial relationship and have substantially the same inside and outside diametrical dimensions. The housing 12 also includes a third elliptical section 18, and a fourth elliptical section 20. The third and fourth elliptical sections 18, 20 are coaxial and each has substantially the same inside and outside diametrical dimensions.

Figure 5:
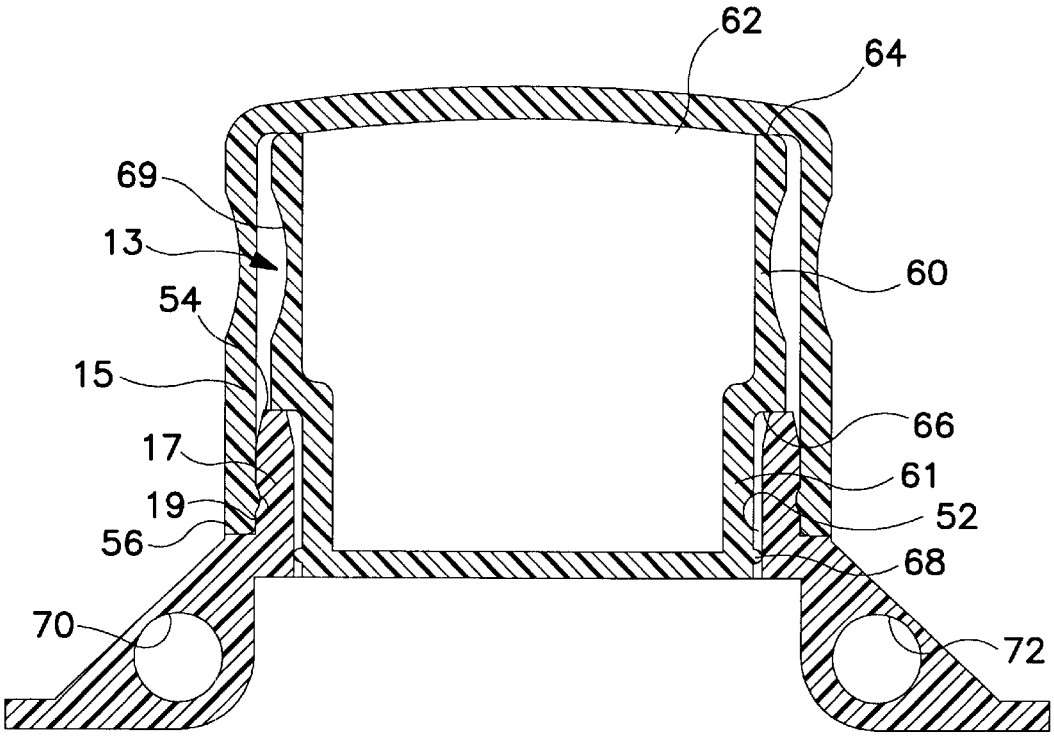
FIG. 5 is an enlarged sectional view of a top portion of the sectional view of FIG. 3.
Figure 6:
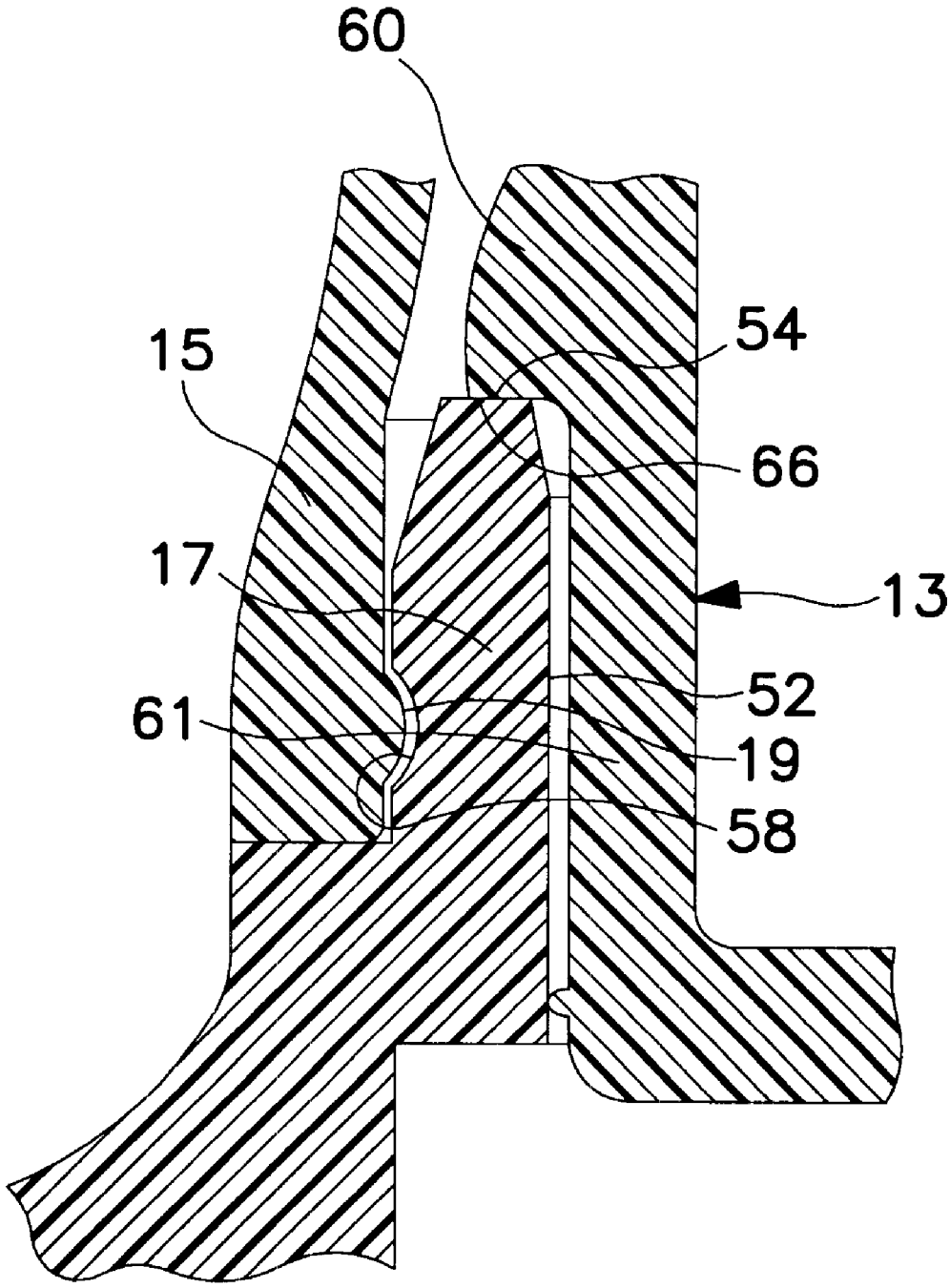
FIG. 6 is an enlarged fragmentary sectional view of the top portion of FIG. 5.
Figure 10:
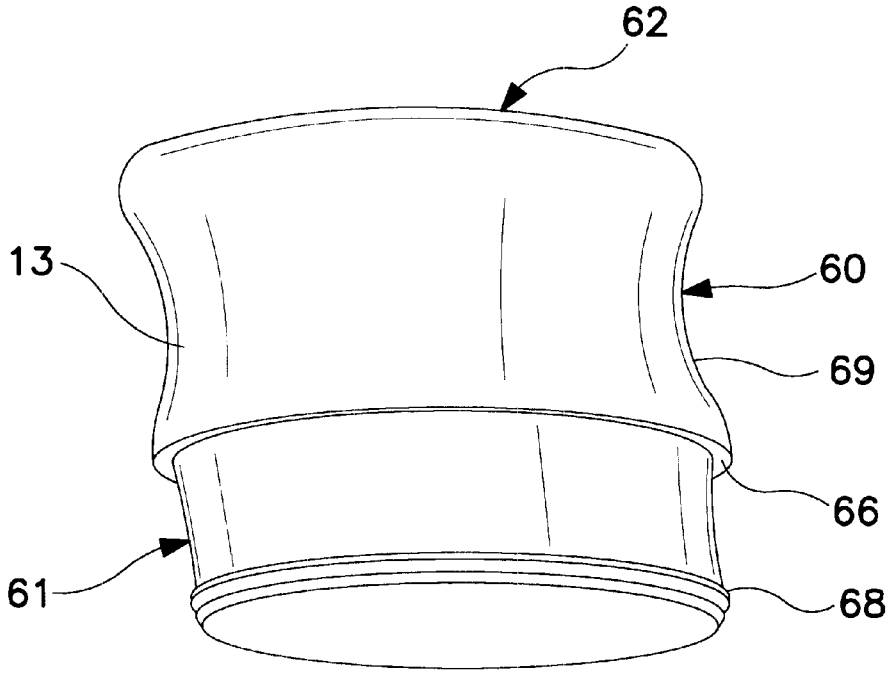
FIG. 10 is an enlarged perspective view of one embodiment of a cap for the flask of FIG. 1.

With reference to FIGS. 5, 6, and 10, the pill container 13 is preferably a cup shaped member which has a slightly enlarged upper portion 60 with an open end 62. The open end 62 is defined by a peripheral annular lip 64 which will engage the underside of the cap 15 when a pill container 13 is properly received or seated in the first section wherein the reduced portion 61 is received in the throat of the neck 17, as will be described below. The pill container 13 includes a medical circumferential annular shoulder 66 as well as an axial spaced lower circumferential seal ring 68.

The first section 14 of the housing includes an inwardly formed axially projecting neck 17 which upwardly terminates in a circumferential lip 54. The neck forms a cylindrical throat 52. The neck also has an exterior annular shoulder 56 and an axially spaced inward circumferential groove 58. As best illustrated in FIG. 5, the pill container 13 is axially inserted into the housing 12 so that the shoulder of the pill container 56 engages the top of the lip 54 of the neck. At the same time, the seal ring 68 on the pill container resiliently engages the throat 52 of the neck to provide a generally fluid tight seal. The cap 15 may then be axially closed over the neck 17 and is efficiently resilient so that an inwardly circumferential detent 19 of the cap snaps into the corresponding groove 58 of the neck. At the same time, the lower end of the cap engages the circumferential shoulder 56 of the neck. The cap is sufficiently resilient that a sealing interface is provided at as many as three locations, namely, the seal ring 58 and the interior throat 52 of the neck, the shoulder 66, the lip 54 and the rim 64 and underside top of the cap.

It will be appreciated that the cap 15 and the pill container 13 may be relatively easily axially removed while also providing the efficient and reliable liquid tight sealing interfaces as previously described.

A pair of apertures 70 and 72 may also be formed adjacent to the intersection of the sections of the cross-shaped housing. These apertures may be used to receive a key ring, a lace or other retaining structures (not illustrated) so that the flask may be relatively efficiently and reliably carried or transported by a user at all times. It should be appreciated that the elliptical sections 16, 18 and 20 essentially provide a reservoir for a liquid. Consequently, the flask combines to provide both a pill container and a convenient source of liquid so that the pill may be readily available and consumable by the liquid at any given time when required.

Figure 7:
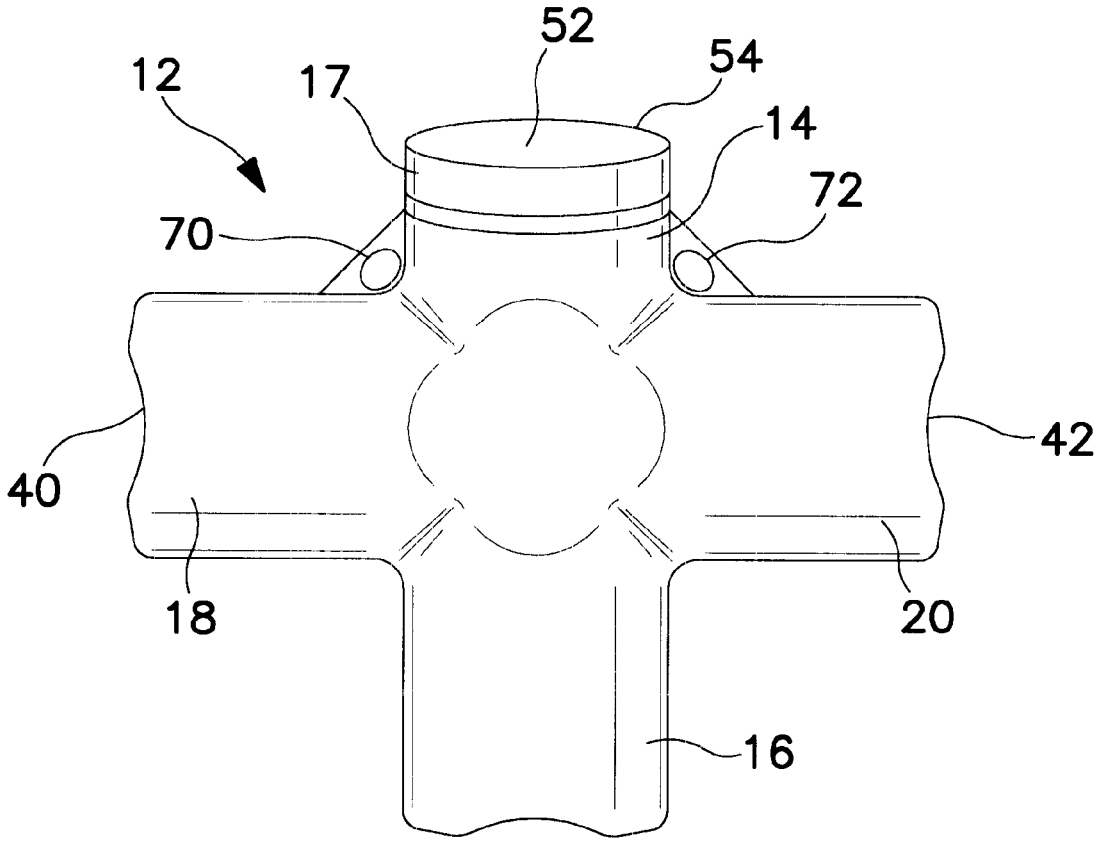
FIG. 7 is a frontal perspective view of a housing portion of the flask of FIG. 1.
Figure 8:
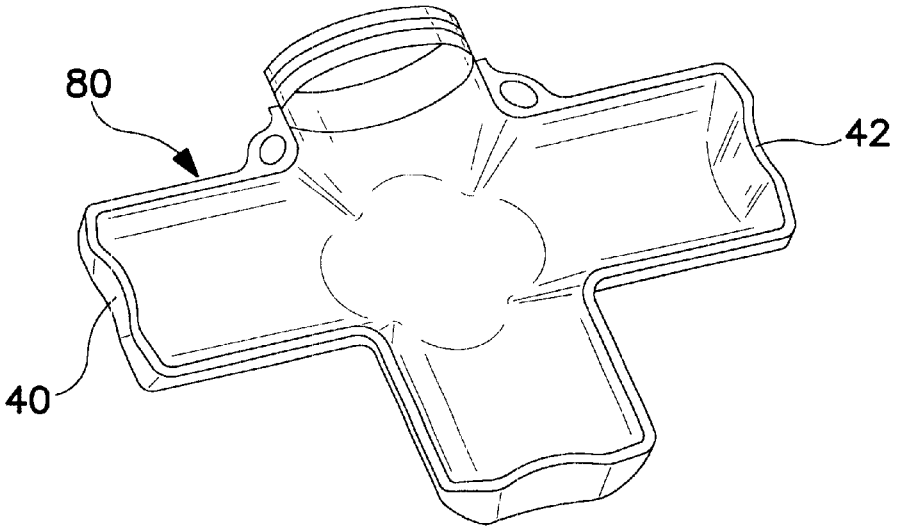
FIG. 8 is a perspective view of one component which may be used to form the housing of FIG. 7.
Figure 9:
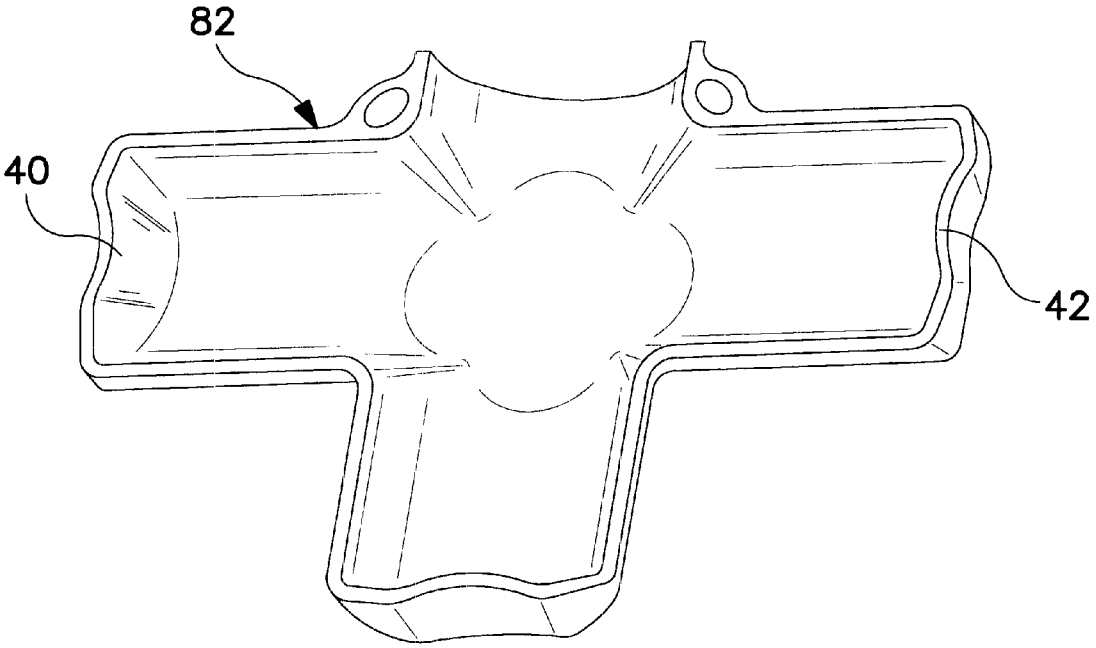
FIG. 9 is a perspective view of a second component which may be used to form the housing of FIG. 7.
Figure 11:
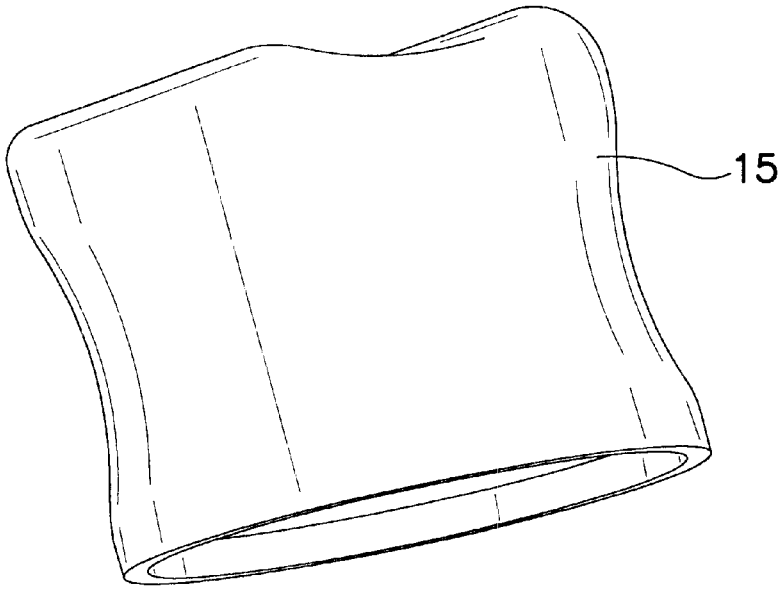
FIG. 11 is an enlarged perspective view of one embodiment of a pill container for the flask of FIG. 1.

It will also be appreciated that the flask may be manufactured in a relatively efficient process which employs two molded components 80 and 82 as illustrated in FIGS. 8 and 9 to form the composite housing 12 structure best illustrated in FIG. 7. The molding process also will provide for the efficient, manually friendly contours which provide for the relative ease with which the flask may be closed and opened by a user. Another feature of the present invention is shown in FIGS. 1, 3 and 7–9. Wherein the axial extremities of the third elliptical section 18 and the fourth elliptical section 20 include inwardly dish-shaped portions that are respectively identified by the reference numerals 40 and 42. As will be apparent by inspection of FIG. 3, these inwardly dish-shaped areas 40, 42 will easily accommodate the thumb and forefinger of a user's hand to facilitate application of the required axial separation force to pull outward (upwardly) on the cap 15. Alternatively, it will be understood by those skilled in the art that even for a person with arthritic hands or hands otherwise weakened by other disabilities, the lateral extent of the second elliptical section 18 and the fourth elliptical section 20 cooperate to allow sufficient closing and separating forces to the housing 12 by a user with relatively weak hand operations to thereby provide firm tightening and untightening of the respective cap 15.

After the cap is removed, the pill container 13 is readily accessible. The pill container may be grasped at the finger indentation 69 and removed so that one or more pills in the container may be taken. This now opens the liquid reservoir formed in the housing so the user may swallow the liquid to take the pills.

In some embodiments of the invention, the axial extremity of the end of section 16 is substantially flat to facilitate standing the flask on a flat horizontal surface. Other embodiments may have part of a hook and eye fastener (such as that sold and marketed with the registered trademark VELCRO) to further facilitate attaching the flask on a flat surface, including a vertical surface. It will thus be seen that the flask 10 enables a user to carry either emergency medicines with a quantity of liquid sufficient to swallow one or more pills, as well as pills that are routinely taken such as those that must be taken on a regular cycle throughout a given day.

Advantageously, the flask 10 of the present invention is fastenable to the key ring or retainer (neither illustrated) through apertures 70 and 72 and/or carried around the neck of the user to further ensure that the user does not forget his medication and ensure that the user retains both the medication and a quantity of fluid to ingest that medication even when away from familiar surroundings as well as when the person is at home.

As will be apparent to persons skilled in the art, various modifications and adaptations of the structure described will become readily apparent without departure from the spirit and scope of the invention.

What is claimed is:

1. A combination flask for carrying a quantity of liquid and at least one pill which comprises:

a housing defining a liquid impervious primary chamber and having a neck;

a pill container removably received in said neck; and a cap engageable with said housing to cover said pill container and close said housing, wherein said pill container is liquid impervious and said primary chamber is capable of retaining liquid wherein said housing is generally cross-shaped, wherein said cross-shaped housing includes four portions each having a generally elliptical section of which first and second generally elliptical sections are generally coaxial and third and fourth elliptical sections are generally coaxial.

2. The apparatus in accordance with claim 1, wherein said pill container is partially received within one of said portions.

3. The flask in accordance with claim 1, wherein said neck defines a recess and said cap comprises a detent configured for engaging said recess.

4. The flask in accordance with claim 1, wherein said pill container further comprises a seal ring which seals against the interior of the neck.

5. The flask in accordance with claim 1, wherein at least one axial extremity of said housing has an end part thereof that is shaped whereby said housing is capable of standing upright on a flat horizontal surface.

6. The flask in accordance with claim 1, wherein said third and fourth elliptical sections have axial extremities that include a dish-shaped end recess, each of said recesses being dimensioned and configured to accommodate a finger of a user.

7. The flask in accordance with claim 1, wherein the housing includes at least one aperture.

8. The flask in accordance with claim 1, wherein the housing has four limbs and has two apertures each positioned adjacent to an exterior intersection of two limbs.

9. The flask in accordance with claim 1, wherein said pill container has an annular shoulder and said neck has a rim, said shoulder engaging said rim.

10. A flask for carrying a quantity of liquid and at least one pill which comprises:

first receptacle means comprising a cup-like container defining a first interior chamber, said first interior chamber being dimensioned and configured for holding at least one pill and being substantially water impervious;

second receptacle means partially receiving said first receptacle means and forming a cross-shaped housing, said second receptacle means defining a second interior chamber;

removable cap means for enclosing said first receptacle means and said second receptacle means to form fluid tight first and second chambers and to provide selective access to said first and second interior chambers said housing has four orthogonally extending portions, each having a generally elliptical section.

11. The flask in accordance with claim 12, wherein said second interior chamber is at least partially defined by two of said elliptical sections.

12. The flask in accordance with claim 12, wherein said second receptacle means comprises a neck terminating in a rim and said first receptacle means defines a circumferential shoulder which engages second rim.

13. The flask in accordance with claim 15, further comprising sealing means for forming a liquid tight seal between said first receptacle means and the interior of said neck.

14. The flask in accordance with claim 15, wherein said first receptacle means further comprises an open end portion which engages the underside of said cap means.

* * * * *

UNITED STATES PATENT AND TRADEMARK OFFICE

CERTIFICATE OF CORRECTION

PATENT NO. : 6,488,169 B1
DATED : December 3, 2002
INVENTOR(S) : Magnusson et al.

It is certified that error appears in the above-identified patent and that said Letters Patent is hereby corrected as shown below:

Column 5,
Line 14, delete “12” and substitute therefor -- 10 --.

Column 6,
Line 1, delete “12” and substitute therefor -- 10 --.
Lines 5 and 8, delete “15” and substitute therefor -- 12 --.

Signed and Sealed this

Twenty-first Day of June, 2005

JON W. DUDAS
*Director of the United States Patent and Trademark Office*